US006685397B1

(12) United States Patent
Dixon-Roche

(10) Patent No.: US 6,685,397 B1
(45) Date of Patent: Feb. 3, 2004

(54) RISER SYSTEM

(76) Inventor: Keith Dixon-Roche, 215 Old Dover Road, Canterbury, Kent (GB), CT1 3ER ( * ) Notice: Subject to any disclaimer, the term of this patent is extended or adjusted under 35 U.S.C. 154(b) by 0 days.

(21) Appl. No.: 10/030,654

(22) PCT Filed: Jul. 10, 2000

(86) PCT No.: PCT/GB00/02653

§ 371 (c)(1),
(2), (4) Date: Jan. 9, 2002

(87) PCT Pub. No.: WO01/04455

PCT Pub. Date: Jan. 18, 2001

(30) Foreign Application Priority Data

Jul. 9, 1999 (GB) ..... 9915998

(51) Int. Cl.[7] ..... E21B 17/01
(52) U.S. Cl. ..... 405/224.2; 166/352; 166/367
(58) Field of Search ..... 166/355, 354, 166/353, 352, 345, 350, 351, 359, 367; 405/224.2, 224.3, 224.4

(56) References Cited

U.S. PATENT DOCUMENTS

| | | | | |
|---|---|---|---|---|
| 4,173,804 A | | 11/1979 | Duc et al. | |
| 4,264,234 A | | 4/1981 | Pras et al. | |
| 4,802,431 A | * | 2/1989 | Pollack | 114/293 |
| 5,288,253 A | * | 2/1994 | Urdshals et al. | 166/355 |

FOREIGN PATENT DOCUMENTS

GB 2313889 A 12/1997

* cited by examiner

*Primary Examiner*—Frederick L. Lagman
(74) *Attorney, Agent, or Firm*—Nixon Peabody LLP

(57) ABSTRACT

Where a submarine wellhead is coupled to a floating vessel by a riser in the form of a flexible hose, vessel movements subject the riser to excessive strains where the riser is tethered ask to the vessel. In accordance with the invention, these strains are reduced by pivoting the riser tether about a horizontal axis, and optionally also about a vertical axis. Giving the riser tether at least one degree of rotational freedom is surprisingly beneficial in reducing riser strains, and consequently in reducing the probability of premature failure of the riser.

9 Claims, 7 Drawing Sheets

RISER SYSTEM

This application is a National Phase Entry Application of co-pending International Application PCT/GB00/002653 filed on Jul. 10, 2000 which designated the U.S. and which claims the benefit of Great Britain Application 9915998.0, filed Jul. 9, 1999.

This invention relates to riser systems, and relates more particularly but not exclusively to riser systems for use in maritime installations wherein a flexible conduit extends between a seabed location and a floating vessel.

It is common practice for submarine wells producing hydrocarbons to have a wellhead mounted on the seabed, with the hydrocarbons recovered from the well being fed to a surface-floating vessel by way of a flexible hose. Such vessels are commonly anchored to the seabed to retain them in suitable proximity to the respective wellheads without the continuous expenditure of energy necessary for dynamic positioning. Nevertheless, moored vessels are not totally static, since they are subject to winds, waves, currents, and tides, with consequent changes in alignment, heading, depth, and position. Thus the point at or near the upper end of the hose where the hose is directly or indirectly tethered to the surface-floating vessel is subjected to considerable tension, and must also accommodate changes in the direction of tension.

It is an object of the invention to provide a riser system in which changes in the direction of tension at or near the upper end of the hose or other form of riser are at least partially accommodated by means other than inherent flexibility of the hose or other form of riser.

As used in the specification and in the appended claims, the term "surface-floating vessel" encompasses semi-submersible floating vessels, and extends to static structures (including non-floating vessels and structures) coupled to one or more risers subjected to directionally variable tensions, e.g. by reason of variable currents or tidal flows, since the invention is applicable in such circumstances.

As used in this specification and in the appended claims, the term "riser" encompasses flexible hoses, flexible conduits, flexible umbilicals, flexible tethers, flexible cables, flexible mooring elements, and functional equivalents thereof in the form of a plurality of relatively short lengths of relatively rigid materials or members mutually linked by articulating joints; i.e. the "riser" can have any suitable physical form, and may be intended to carry fluids, or the riser may simply be a tension-transmitting member not intended to transport fluids. Equally, the riser may be a steel pipe.

According to the present invention there is provided a riser system comprising a riser which extends from a lower end location to an upper end location whereat the riser is tethered by .a tether means comprised in the riser system, the tether means comprising a riser clamp means and a pivot means coupling the riser clamp means to an anchorage, the pivot means having at least one degree of rotational freedom.

Said at least one degree of rotation freedom preferably comprises freedom to rotate about a substantially horizontal axis, the substantially horizontal axis preferably being substantially orthogonal to a substantially vertical plane including the catenary or other shape formed by the riser under the composite influences of gravity and flotation.

The pivot means may have a second degree of rotational freedom, preferably comprising freedom to rotate about a substantially vertical axis.

The riser clamp means may comprise an elbow means to which the riser is clamped against longitudinal movement while maintaining through passage of fluid where the riser is a hose or other fluid conduit, or the riser clamp means may comprise a termination for the riser, the termination being constructed or adapted to maintain through passage of fluid from the riser where the riser is a hose or other fluid conduit. In either case, where the riser is a hose or other fluid conduit, the riser clamp means is preferably coupled by a further flexible or articulated hose or other fluid conduit to static pipework downstream of the riser system.

Embodiments of the invention will now be described by way of example, with reference to the accompanying drawings wherein.

Figure 1:
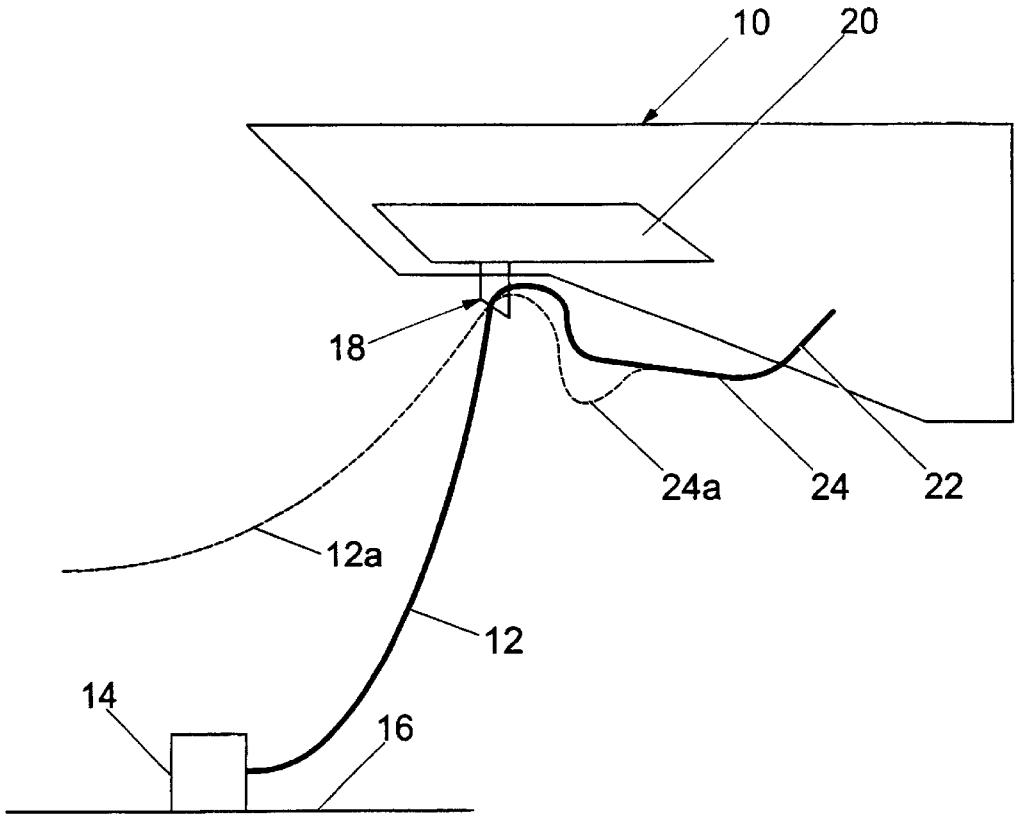
FIG. 1 is a schematic representation of the dynamic metamorphism of a riser system in accordance with the invention.

Referring first to FIG. 1, this Figure schematically depicts a surface-floating vessel 10 to which a flexible hose 12 extends from a wellhead 14 mounted on the seabed 16. The upper end of the riser 12 is tethered to the vessel 10 by a tether system 18 (detailed with reference to subsequent Figures). The tether system 18 is mounted on an overhanging bracket or roof structure 20 cantilevered to the structure of the vessel 10. Between the tether system 18 and static pipework 22 fixed on the vessel 10, a further and relatively short flexible linking hose 24 completes the flow path for fluids from the wellhead 14 via the riser 12 to the vessel pipework 22.

Because the surface-floating vessel 10 is subject to weather and ocean conditions, the alignment, position, and depth of the vessel 10 are variable, with consequent variations in the extent and direction of separation of the vessel-mounted tether system 18 from the seabed-fixed wellhead 14. These variations result in deviations of the riser 12 from its nominal position with respect to the vessel 10 (shown in full line), to a maximally deviated position schematically depicted in dashed line at 12A. The corresponding maximally deviated position of the linking hose 24 is schematically depicted in dashed outline at 24A. If the riser 12 were simply clamped to an immobile anchor point on the vessel 10, with reliance solely on the inherent flexibility of the riser 12 to accommodate these aforementioned deviations, excessive strains would be imposed on the riser 12 in the vicinity of its point of clamping, with consequent risk of premature failure. In accordance with the invention, the tether system 18 incorporates a pivot system (detailed below) in order to relieve the riser 12 of such excessive strains.

Figure 2:
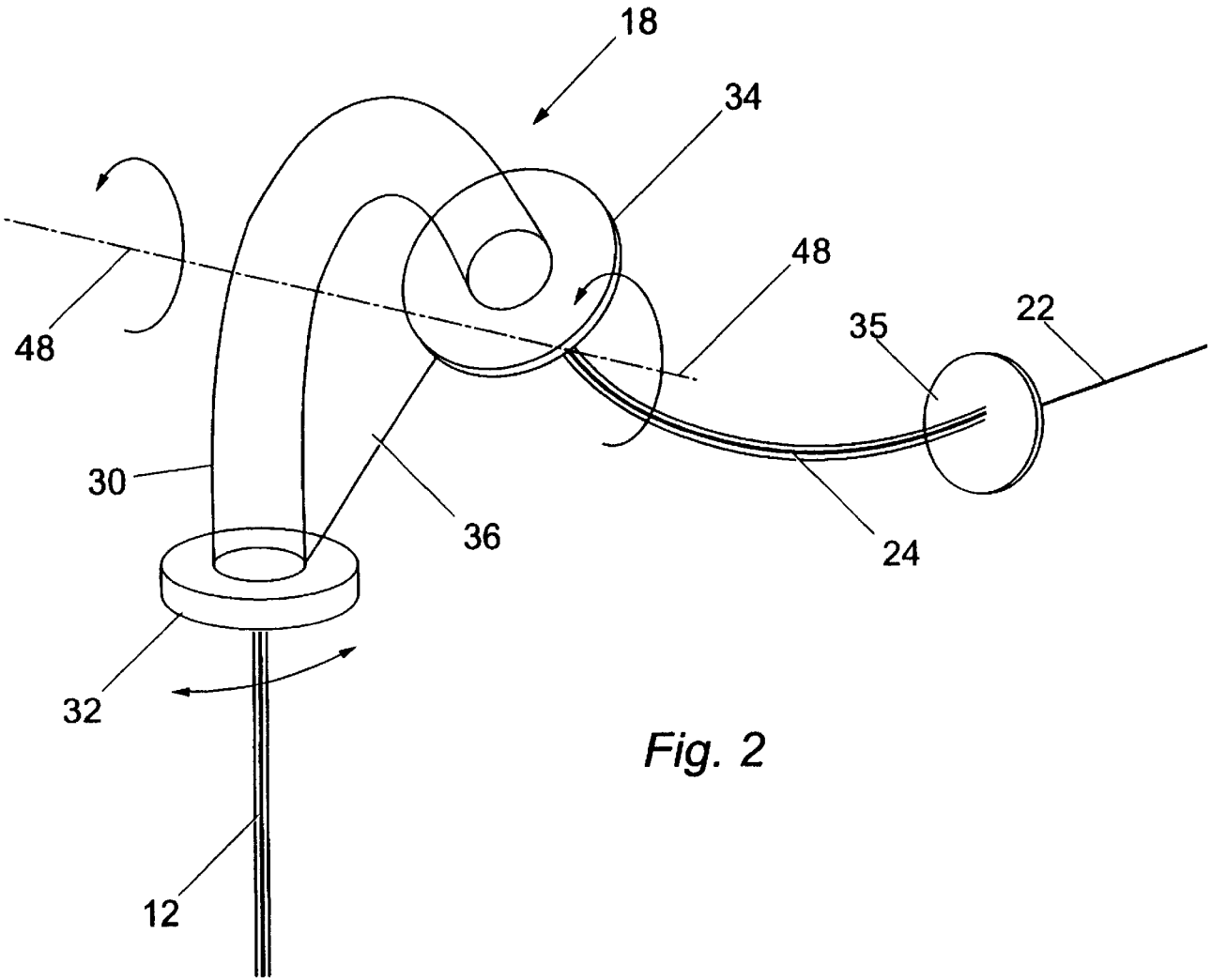
FIG. 2 is a schematic perspective view of a first embodiment of riser system in accordance with the invention.
Figure 3:
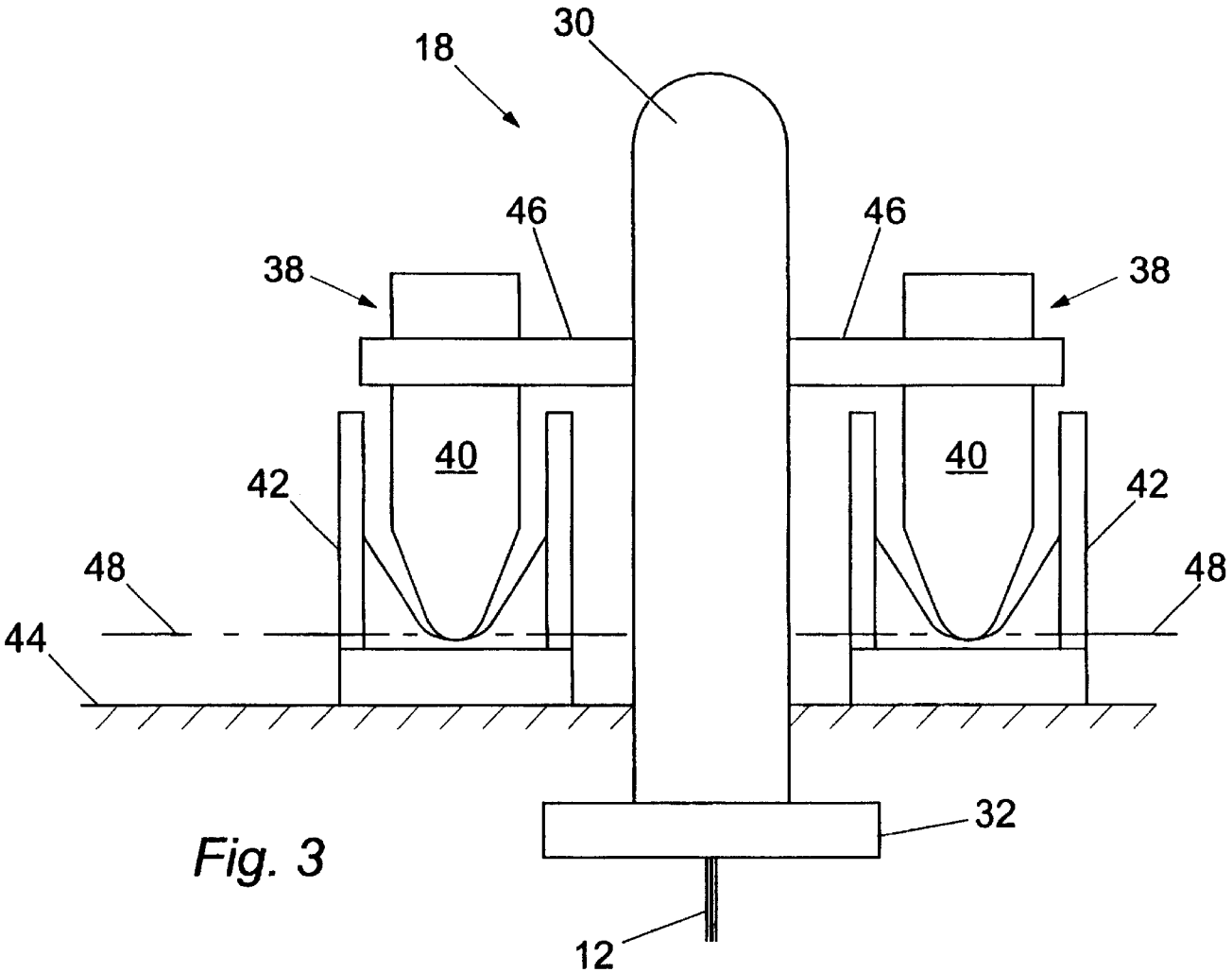
FIG. 3 is an end elevation of the first embodiment.

Referring now to FIGS. 2 and 3, these schematically depict a first embodiment of the tether system 18. A hollow tubular elbow 30 is coupled by a coupling 32 at its upstream end to the upper end of the riser 12 (which is the downstream end of the riser 12 in terms of normal flow of fluids from the wellhead 14 to the vessel 10). The elbow 30 is coupled by a coupling 34 at its downstream end to the upstream end of the linking hose 24. A coupling 35 couples the downstream end of the linking hose 24 to the upstream (flow-receiving) end of the static pipework 22.

The elbow 30 is formed of rigid steel tube, and provides a pressure-tight through path for fluids flowing up the riser 12 and out through the linking hose 24. The elbow 30 is reinforced by a sheet steel web 36 which extends across the inside curve of the elbow 30 and is peripherally welded to the steel tube forming the elbow 30.

The tether system 18 is provided with a pivot system in the form of a pair of rocking trunnions 38 (FIG. 3; not shown in FIG. 2). Each trunnion 38 comprises a pivot 40 depending into a respective cradle 42 mounted on a static bracket 44 secured to a suitable part of the structure of the vessel 10 (e.g. to the underside of the roof structure 20). The pivots 40 are mounted on either end of a support 46 extending horizontally through and fixedly secured to the web 36. The contacts of the lower ends of the pivots 40 with the insides of the cradles 42 provide the tether system 18 with rotational freedom about a horizontal axis 48.

Figure 5:
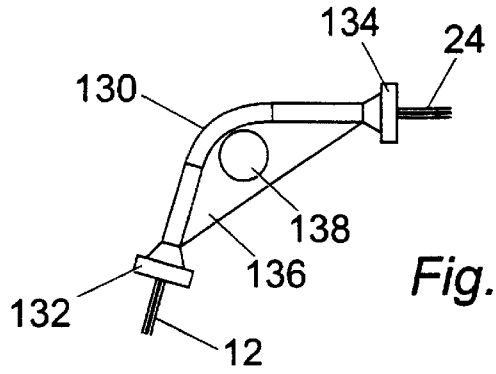
FIG. 5 is a side elevation of the second embodiment.
Figure 4:
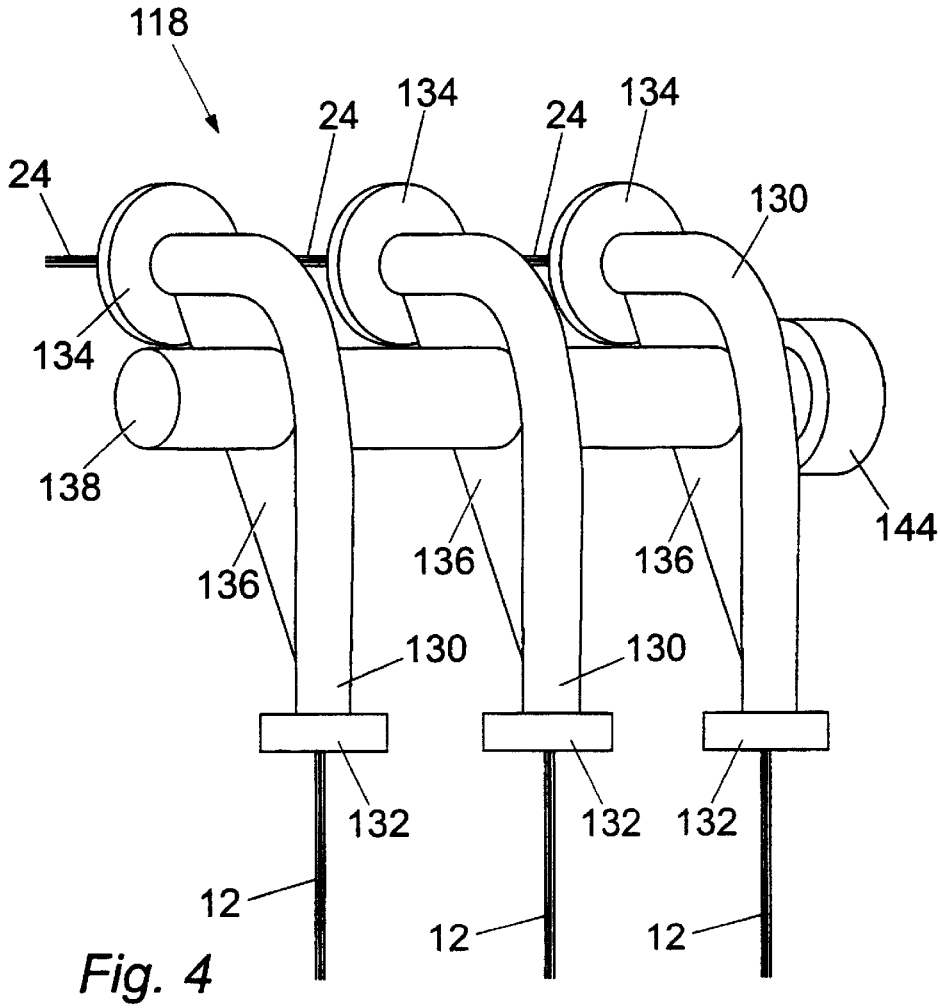
FIG. 4 is a schematic perspective view of a second embodiment of riser system in accordance with the invention.

Referring now to FIGS. 4 and 5, these show a second embodiment 118 of the tether system in accordance with the invention, in the form of an adaptation of the first embodiment 18 to cope with multiple risers (three risers 12 being shown by way of example in the second embodiment 118). The tether system 118 as shown in FIG. 4 comprises three elbows 130 each tethering a respective riser 12 and coupling that riser to a respective linking hose 24. An individual one of the three mutually identical elbows 130 is shown in side elevation in FIG. 5. Each elbow 130 is formed of rigid steel tube, and is reinforced by a sheet steel web 136 which also supports the elbow 130 on a horizontal pivot 138. Each elbow 130 has a coupling 132 for connecting the upper end of the respective riser 12, and a coupling 134 for connecting the upstream end of the respective linking hose 24. The horizontal pivots 138 separately pivot each elbow 130 on a common horizontal axle secured by a bracket 144 to a suitable part of the structure of the vessel 10.

Figure 6:
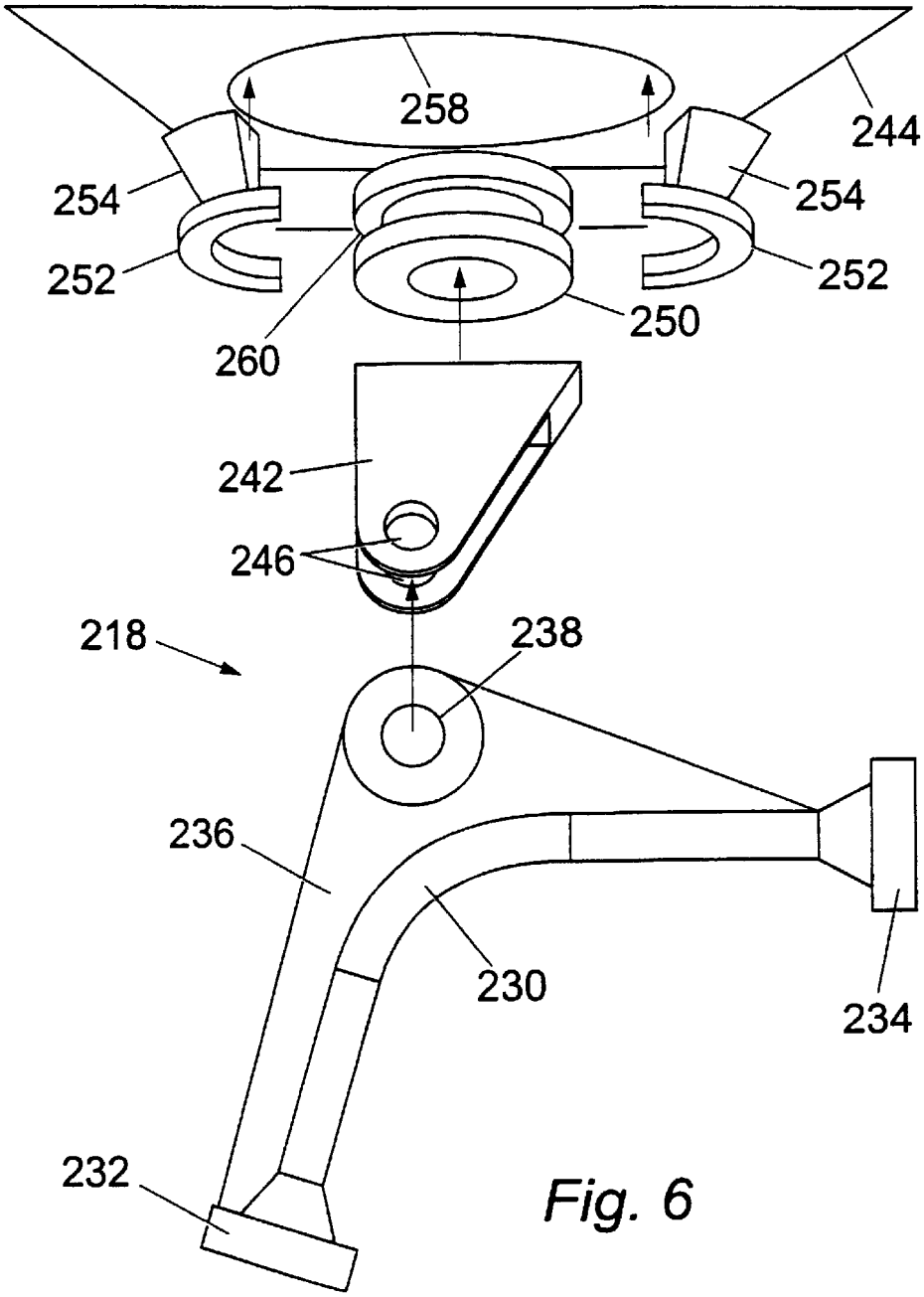
FIG. 6 is a semi-schematic exploded side elevation of a third embodiment of riser system in accordance with the invention.
Figure 7:
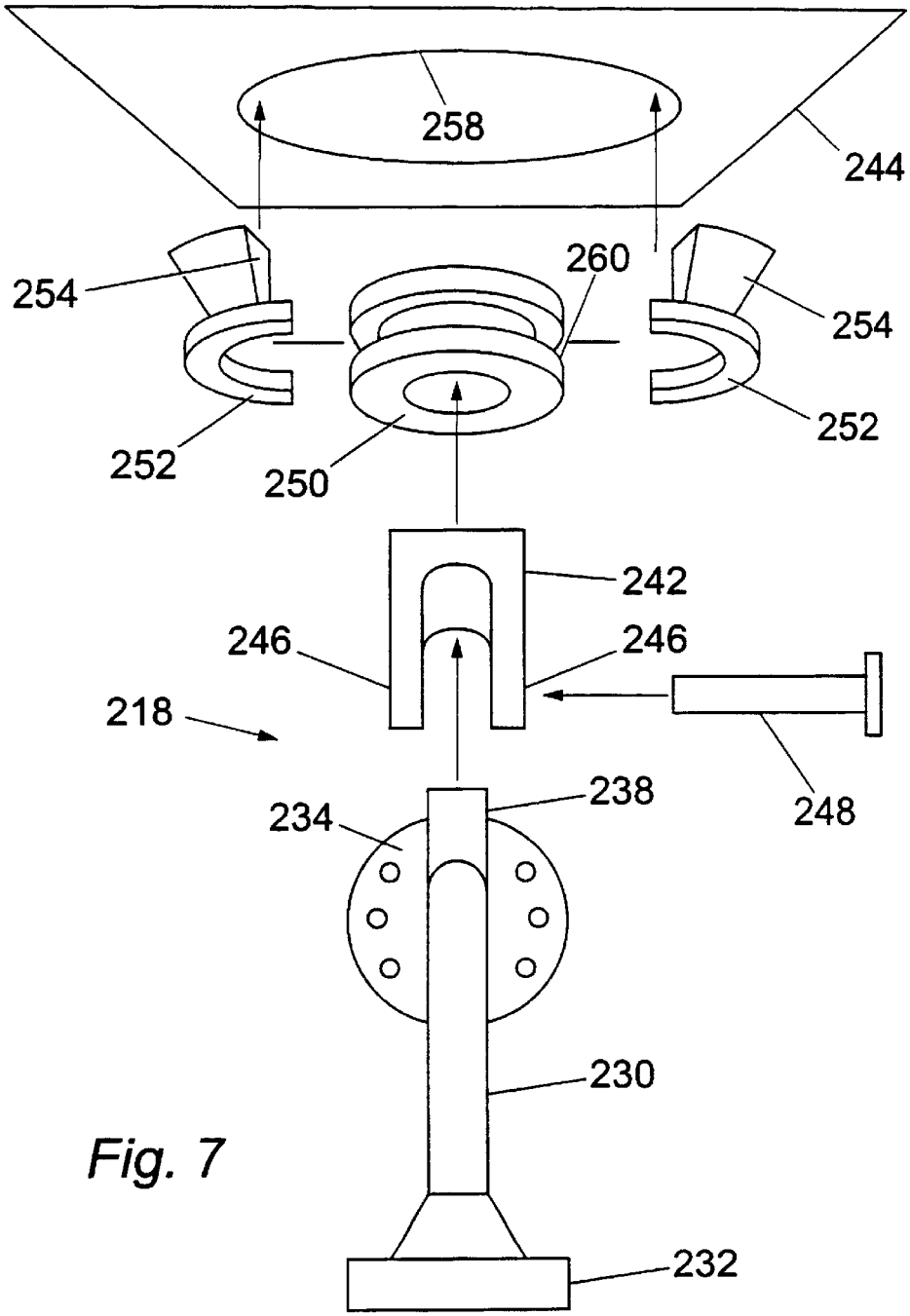
FIG. 7 is a semi-schematic exploded end elevation of the third embodiment.
Figure 8:
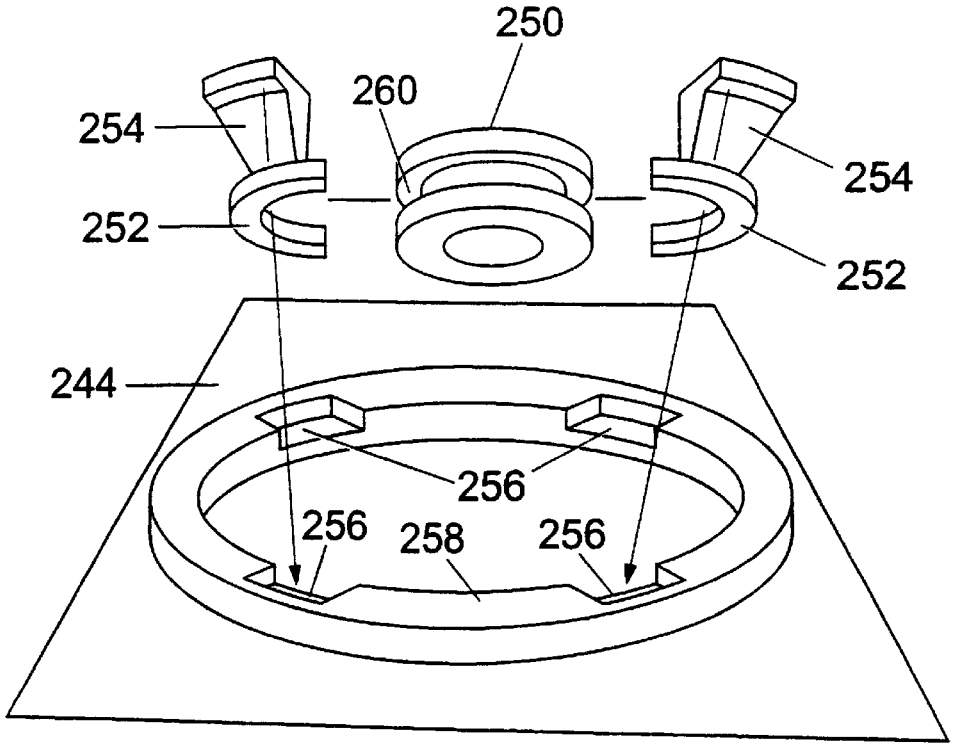
FIG. 8 is a semi-schematic exploded perspective view of part of the third embodiment.

Referring now to FIGS. 6 and 7, these show, in semi-schematic exploded side and end views respectively, a third embodiment 218 of tether system in accordance with the invention, in the form of an adaptation of the first embodiment 18 to have a second degree of rotational freedom. (FIG. 8 shows part of the tether system 218 in semi-schematic exploded view).

Similarly to the first and second embodiments, the third embodiment 218 comprises an elbow 230 of rigid steel tube, reinforced by a steel web 236 which, in this embodiment, is welded to the outside curve of the elbow 230. A pivot bush 238 is secured to the heel of the web 236. Couplings 232 and 234 connect the elbow 230 to a riser and to a linking hose respectively (omitted from FIGS. 6–8).

A trunnion or padeye 242 suspends the elbow 230 by a pivot pin 248 (FIG. 7 only) passing horizontally through pivots 246 formed in the lower ends of the padeye 242, the pivot pin also passing through the elbow pivot bush 238 which is located between the lower ends of the padeye 242 in the assembled tether system 218. The pivots 238 and 246 give the elbow 230 a first degree of rotational freedom, about a nominally horizontal axis.

In order to give the elbow 230 a second degree of rotational freedom, about a nominally vertical axis, the padeye 242 is suspended from a vertical pivot system comprising an inner ring 250 and a pair of semi-circular split collars 252 together forming an outer ring. The inner ring 250 is secured to the upper end of the padeye 242. The split collars 252 are each suspended by a respective pair of integral suspension feet 254 (only one foot 254 per split collar 252 being shown in FIGS. 6–8, the other of the pair of feet being omitted for clarity). As shown in FIG. 8, each of the feet 254 is located in and hangs from a respective one of four equi-angularly spaced notches 256 formed in a suspension ring 258 such that in the assembled tether system 218, the split collars 252 encircle the inner ring 250 and lodge within a peripheral groove 260 formed around the circumference of the inner ring 250. The combination of the split collars 252 and the groove 260 allow the inner ring 250 to pivot around a vertical axis coaxial with the suspension ring 258, and consequently allow the attached padeye 242 and the suspended elbow 230 also to pivot around this vertical axis. Consequently, the elbow 230 can independently rotate around a horizontal axis and a vertical axis.

The suspension ring 258 circumscribes a suitably dimensioned hole formed in a suspension bracket 244 cantilevered from a suitable part of the structure of the vessel 10. (The bracket 244 is equivalent to the bracket 20 schematically depicted in FIG. 1). The bracket 244 thus carries the static weight of the tether system 218, and the net weight (gravity minus flotation, if any) of the riser tethered by the tether system 218, together with dynamic loading imposed by movements of the vessel 10, but alleviated by the rotational freedoms imparted by the horizontal and vertical pivot systems built in to the tether system 218 as detailed above.

The suspension bracket 244 at least partially overhangs the upper end of the riser, and the suspension bracket 244 may be formed as a roof-like structure to obviate adverse affects on the upper end of the riser that may arise from rainstorms, snowfall, or extremes of solar radiation.

While certain modifications and variations of the invention have been described above, the invention is not restricted thereto, and other modifications and variations can be adopted without departing from the scope of the invention as defined in the appended claims.

What is claimed is:

1. A riser system comprising a riser which extends from a lower end location to an upper end location whereat the riser is tethered by a tether means comprised in the riser system, characterised in that the tether means comprises a riser clamp means and a pivot means coupling the riser clamp means to an anchorage, the pivot means having at least one degree of rotational freedom, and in which the riser clamp means comprises an elbow means to which the riser is clamped against longitudinal movement while maintaining through passage of fluid where the riser is a fluid conduit.

2. A riser system as claimed in claim 1, characterized in that said at least one degree of rotational freedom comprises freedom to rotate about a substantially horizontal axis.

3. A riser system as claimed in claim 2, characterized in that said substantially horizontal axis is substantially orthogonal to a substantially vertical plane including the catenary or other shape formed by the riser under the composite forces of gravity and flotation.

4. A riser system as claimed in claim 1, characterized in that the pivot means has at least two degrees of rotational freedom.

5. A riser system as claimed in claim 4, characterized in that said at least two degrees of rotational freedom comprise freedom to rotate about a substantially horizontal axis and also freedom to rotate about a substantially vertical axis.

6. A riser system as claim in claim 1, characterized in that the riser clamp means comprises a termination for the riser, the termination being constructed or adapted to maintain the through passage of fluid from the riser where the riser is a fluid conduit.

7. A riser system as claimed in claim 6 wherein the riser is a hose or other fluid conduit, characterized in that the riser clamp means is coupled by a further flexible or articulated hose or other fluid conduit to static pipework downstream of the riser system.

8. A riser system comprising a plurality of risers each extending from a respective lower end location to a respective upper end location whereat the riser is tethered by a respective tether means comprised in the riser system, characterized in that each said riser forms part of a respective riser system as claimed in claim 1.

9. The combination of a surface-floating vessel, at least one seabed wellhead, and a riser system as claimed in claim 1 linking the or each said wellhead to said vessel.

* * * * *